US011114750B1

(12) United States Patent
Turner et al.

(10) Patent No.: US 11,114,750 B1
(45) Date of Patent: Sep. 7, 2021

(54) SATELLITE ANTENNA HAVING FIDUCIAL DEVICES FOR COMPENSATING PHYSICAL DISTORTION AND ASSOCIATED METHODS

(71) Applicant: EAGLE TECHNOLOGY, LLC, Melbourne, FL (US)

(72) Inventors: Gregory M. Turner, West Melbourne, FL (US); Robert M. Taylor, Rockledge, FL (US); Timothy L. Fetterman, Palm Bay, FL (US); Richard A. Salyer, Rockledge, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 16/988,806

(22) Filed: Aug. 10, 2020

(51) Int. Cl.

| | |
|---|---|
| ***H01Q 1/28*** | (2006.01) |
| ***H01Q 1/12*** | (2006.01) |
| ***H01Q 1/52*** | (2006.01) |
| ***H01Q 3/26*** | (2006.01) |

(52) U.S. Cl.
CPC ..... *H01Q 1/288* (2013.01); *H01Q 1/1228* (2013.01); *H01Q 1/1235* (2013.01); *H01Q 1/526* (2013.01); *H01Q 3/2658* (2013.01)

(58) Field of Classification Search
CPC ..... H01Q 1/288; H01Q 15/161; H01Q 1/10; H01Q 1/14; H01Q 1/1242; H01Q 3/2658; H01Q 1/526; H01Q 1/1228; H01Q 1/1235
See application file for complete search history.

(56) References Cited

U.S. PATENT DOCUMENTS

| | | | | |
|---|---|---|---|---|
| 4,380,013 A * | 4/1983 | Slysh | H01Q 1/288 343/753 |
| 4,578,680 A | 3/1986 | Haupt | |
| 4,586,051 A | 4/1986 | Saitto et al. | |
| 5,200,758 A * | 4/1993 | Gillard | H01Q 15/147 343/880 |
| 6,333,712 B1 | 12/2001 | Haugse et al. | |

(Continued)

FOREIGN PATENT DOCUMENTS

| | | |
|---|---|---|
| TW | 442999 | 6/2001 |

OTHER PUBLICATIONS

Robert M. Taylor, U.S. Appl. No. 17/114,637, filed Dec. 8, 2020.

(Continued)

*Primary Examiner* — Dimary S Lopez Cruz
*Assistant Examiner* — Yonchan J Kim
(74) *Attorney, Agent, or Firm* — Allen, Dyer, Doppelt + Gilchrist, P.A.

(57) ABSTRACT

A satellite antenna includes first and second extensible booms and first and second sets of ribs carried by the respective first and second extensible booms. A Radio Frequency (RF) reflective film is carried by the first and second sets of ribs. First and second phased array antenna feeds are carried by the respective first and second extensible booms and directed toward the RF reflective film. First and second sets of fiducial devices are carried by the respective first and second sets of ribs. At least one camera is directed toward the first and second sets of fiducial devices to sense a physical distortion of the RF reflective film. A controller cooperates with the at least one camera to operate the first and second sets of phased array antenna feeds to account for sensed physical distortion of the RF reflective film.

23 Claims, 9 Drawing Sheets

E

(56) References Cited

U.S. PATENT DOCUMENTS

| | | | | |
|---|---|---|---|---|
| 6,353,421 | B1 * | 3/2002 | Lalezari ..... | H01Q 1/288 343/881 |
| 6,954,173 | B2 | 10/2005 | Mrstik | |
| 10,652,065 | B2 | 5/2020 | Sarkas et al. | |
| 2005/0001760 | A1 | 1/2005 | Mrstik | |
| 2020/0092153 | A1 | 3/2020 | Sarkas et al. | |

OTHER PUBLICATIONS

Steven A. Lane et al.; "Overview of the Innovative Space-Based Radar Antenna Technology Program;" Journal of Spacecraft and Rockets, vol. 48, No. 1, Jan.-Feb. 2011, pp. 135-145.

Congsi Wang et al.; "Active Surface Compensation for Large Radio Telescope Antennas;" International Journal of Antennas and Propagation, vol. 2018, Article ID 3903412, https://doi.org/10.1155/2018/3903412, pp. 1-17.

* cited by examiner

SATELLITE ANTENNA HAVING FIDUCIAL DEVICES FOR COMPENSATING PHYSICAL DISTORTION AND ASSOCIATED METHODS

FIELD OF THE INVENTION

The present invention relates to the field of antennas, and more particularly, to an antenna for a satellite that accounts for sensed physical distortion and related methods.

BACKGROUND OF THE INVENTION

Large antennas for satellites may undergo physical distortions due to vibration, thermal effects, and other factors. For example, the distortion of a 30 meter antenna on its Radio Frequency (RF) reflector surface can range up to 5 millimeters or more at either end depending on the antenna design. If the magnitude of the distortion is a significant fraction of an operating wavelength, the antenna performance may degrade. In some cases, this degradation in antenna performance may significantly impact the operation of the antenna and satellite, especially with large antennas having dimensions of hundreds of wavelengths.

One approach to mitigate distortion effects in the antenna is to design the antenna to minimize the physical distortion sensitivity. For example, rigid and heavy arms that support an RF reflective film may be attached to each other and to the satellite body or an antenna support pedestal to reduce distortion of the RF reflective film. This rigid design, however, results in increased weight and costs for the antenna, and is still a challenge for larger satellite antennas, which still may have some physical distortion during satellite operation.

There are other techniques to compensate for physical distortion in satellite antennas. In a phased array antenna, for example, it is possible to sense the antenna strain and physical distortion using strain gauges located on truss arms and generate a compensation signal at a controller connected to the phased array antenna and the phased array feeds. The controller compensates by inducing a phase shift in the signal transmitted or received by the phased array antenna as a result of the RF reflector surface distortion. Strain gauges, however, may be inaccurate depending on thermal and other effects. Other mitigation techniques incorporate a laser range finder that systematically and periodically senses different parts of the antenna at different times. This may also create a chance of error in measurements over time.

The Defense Advanced Research Projects Agency (DARPA) initiated an Innovative Space-Based Radar Antenna Technology (ISAT) program to investigate critical satellite technologies, including antenna metrology and physical distortion or deformation compensation of large, deployable space radar antennas, such as a 300 meter phased array antenna described in the article from Lane et al., "Overview of the Innovative Space-Based Radar Antenna Technology Program" (2010). In this study, a phased array reflector was modeled to include a deployable support truss and a phased array electronically scanned array (ESA) cooperating with the phased array RF reflector surface positioned on the deployable support truss. In a ground-based test set-up, fiducials were distributed in a rectangular pattern on a single reflector panel, which was imaged by a camera. No further experiments occurred. Although this experiment showed that imaging could sense physical distortions in a phased array antenna, the results as applied to an entire satellite antenna were inconclusive, and there is a need for a phased array antenna having an RF reflective film that may efficiently account for sensed physical distortion of the RF reflective film.

SUMMARY OF THE INVENTION

In general, an antenna for a satellite may include first and second extensible booms, each configured to extend outwardly from the satellite in opposite directions from a stored position to a deployed position. A first set of ribs may be carried by the first extensible boom and a second set of ribs may be carried by the second extensible boom. The first and second sets of ribs may be configured to be in spaced apart relation when the first and second booms are in the deployed position. A Radio Frequency (RF) reflective film may be carried by the first and second sets of ribs to define a curved RF reflector surface. A first set of phased array antenna feeds may be carried by the first extensible boom, and a second set of phased array antenna feeds may be carried by the second extensible boom. The first and second sets of phased array antenna feeds may be directed toward the RF reflective film.

A first set of fiducial devices may be carried by the first set of ribs, and a second set of fiducial devices may be carried by the second set of ribs. At least one camera may be directed toward the first and second sets of fiducial devices to sense a physical distortion of the RF reflective film. A controller may cooperate with at least one camera to operate the first and second sets of phased array antenna feeds to account for sensed physical distortion of the RF reflective film.

The at least one camera may comprise a first camera directed toward the first set of fiducial devices, and a second camera directed toward the second set of fiducial devices. For example, in one embodiment, the first and second cameras may be positioned at a midpoint between the first and second extensible booms. In another embodiment, the first camera may be carried at a distal end of the first extensible boom, and the second camera may be carried at a distal end of the second extensible boom. The at least one camera may comprise an optical sensor and a sun shield associated therewith, for example.

In yet another example, each of the first and second fiducial devices may comprise a passive fiducial device. In another embodiment, each of the first and second fiducial devices may comprise an active fiducial device. A cord network may be coupled to the first and second sets of ribs. The RF reflective film may comprise an RF reflective mesh, for example.

Another aspect is directed to a method for deploying and using an antenna for a satellite that may comprise extending first and second extensible booms of the antenna outwardly from the satellite in opposite directions from a stored position to a deployed position. The antenna may comprise a first set of ribs carried by the first extensible boom, and a second set of ribs carried by the second extensible boom. The first and second sets of ribs may be moved into spaced apart relation when the first and second booms are moved into the deployed position. A Radio Frequency (RF) reflective film may be carried by the first and second sets of ribs to define a curved RE reflector surface. A first set of phased array antenna feeds may be carried by the first extensible boom, and a second set of phased array antenna feeds may be carried by the second extensible boom, the first and second sets of phased array antenna feeds directed toward the RE reflective film. A first set of fiducial devices may be carried by the first set of ribs and a second set of fiducial devices may be carried by the second set of ribs. At least one camera may be directed toward the first and second sets of fiducial devices to sense a physical distortion of the RF reflective film. The method may also include operating a controller to cooperate with the at least one camera to operate the first and second sets of phased array antenna feeds to account for sensed physical distortion of the RF reflective film.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION

The present description is made with reference to the accompanying drawings, in which exemplary embodiments are shown. However, many different embodiments may be used, and thus, the description should not be construed as limited to the particular embodiments set forth herein. Rather, these embodiments are provided so that this disclosure will be thorough and complete. Like numbers refer to like elements throughout, and prime notation is used to indicate similar elements in different embodiments.

Figure 1:
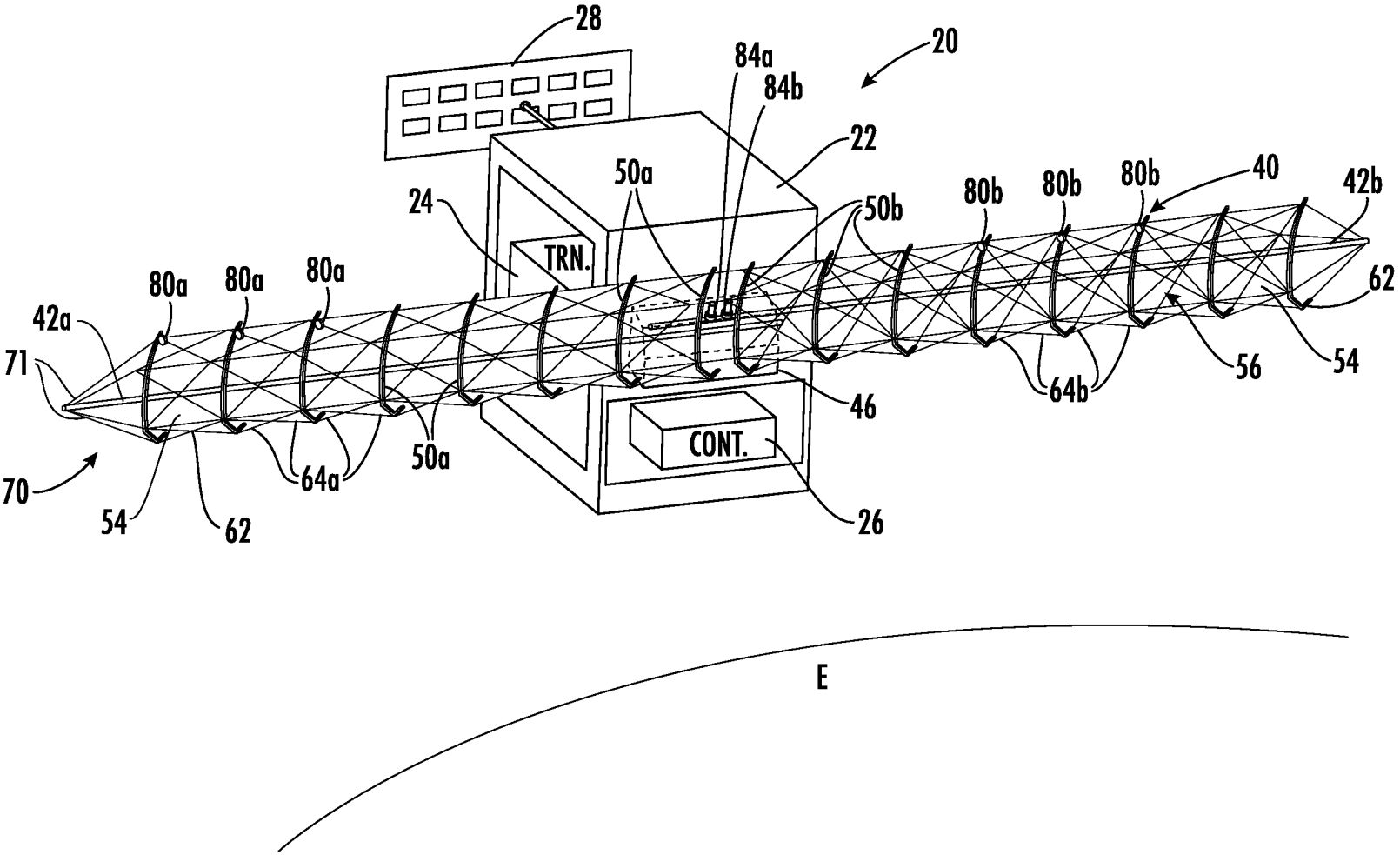
FIG. 1 is a perspective view of the antenna mounted on a satellite and using a camera and fiducial devices for compensating physical distortion in accordance with a non-limiting example.

Referring initially to FIG. 1, a satellite is illustrated generally at 20 and shown orbiting Earth (E), such as at a mid-Earth orbit (MEO), although other satellite orbit altitudes may be established depending on satellite functions and design. The satellite 20 includes a satellite housing 22 shown in partial cut-away, and a satellite transceiver 24 and controller 26 carried by the satellite housing and shown through the cut-away sections. Solar panels 28 provide power that is stored in a satellite battery (not shown) contained in the satellite housing 22 to power the satellite transceiver 24, controller 26, and other components. The satellite transceiver 24, controller 26, and any associated electronic components and circuits may be formed from conventional off-the-shelf (COTS) components or be custom manufactured for the satellite 20.

An antenna for the satellite 20 is indicated generally at 40 and formed as a phased array antenna and carried by the satellite housing 22 and coupled to the satellite transceiver 24 and controller 26. Although an antenna 40 for a satellite 20 is described, the antenna can be used for terrestrial and other applications. The antenna 40 may be a direct radiating phased array antenna with no reflector and the antenna may be a phased array fed reflector antenna as described in further detail below. The antenna 40 includes first and second extensible booms 42*a*, 42*b*, also shown in greater detail in FIGS. 6 and 7, each configured to extend outwardly from the satellite 20 in opposite directions from a stored position to a deployed position. The first and second extensible booms 42*a*, 42*b*, in this example, are mounted on a support pedestal 46 that extends outward from the satellite housing 22 upon deployment of the antenna 40 when the satellite 20 reaches the desired altitude for operation.

Figure 6:
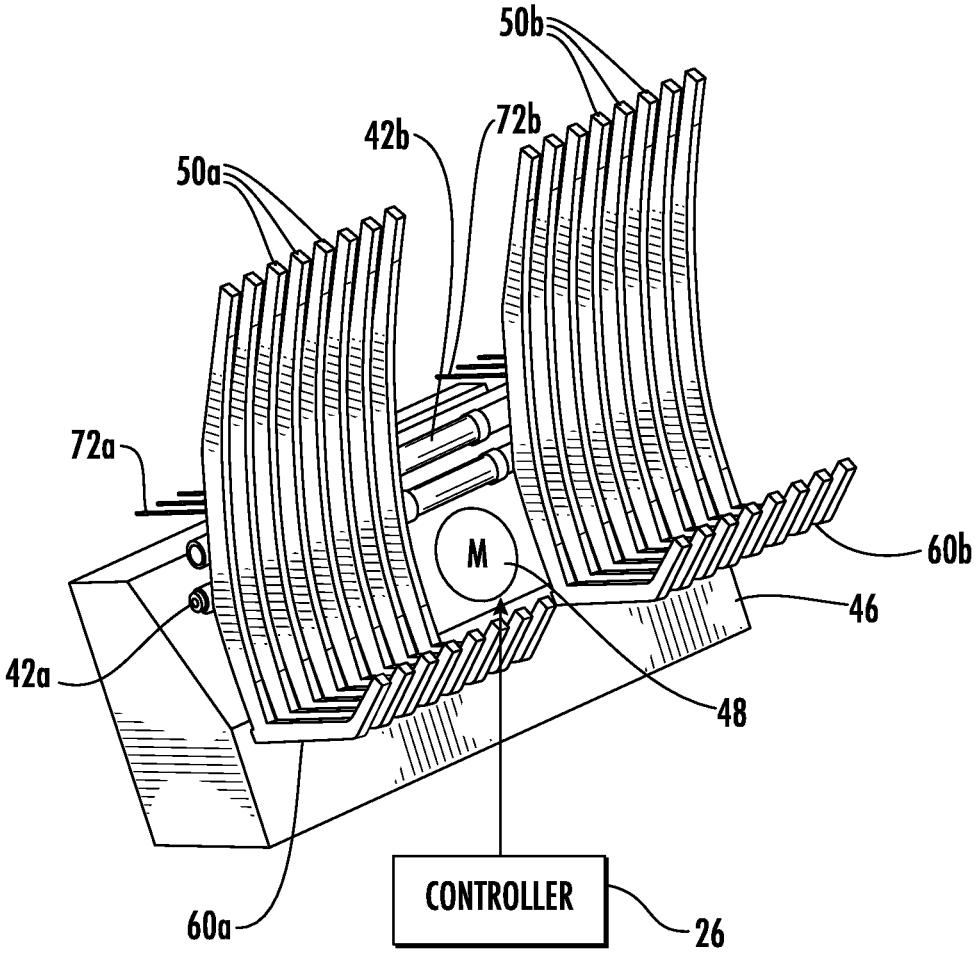
FIG. 6 is a fragmentary, isometric view of the first and second extensible booms carrying first and second sets of ribs in a stored position for the antenna of FIG. 1.
Figure 7:
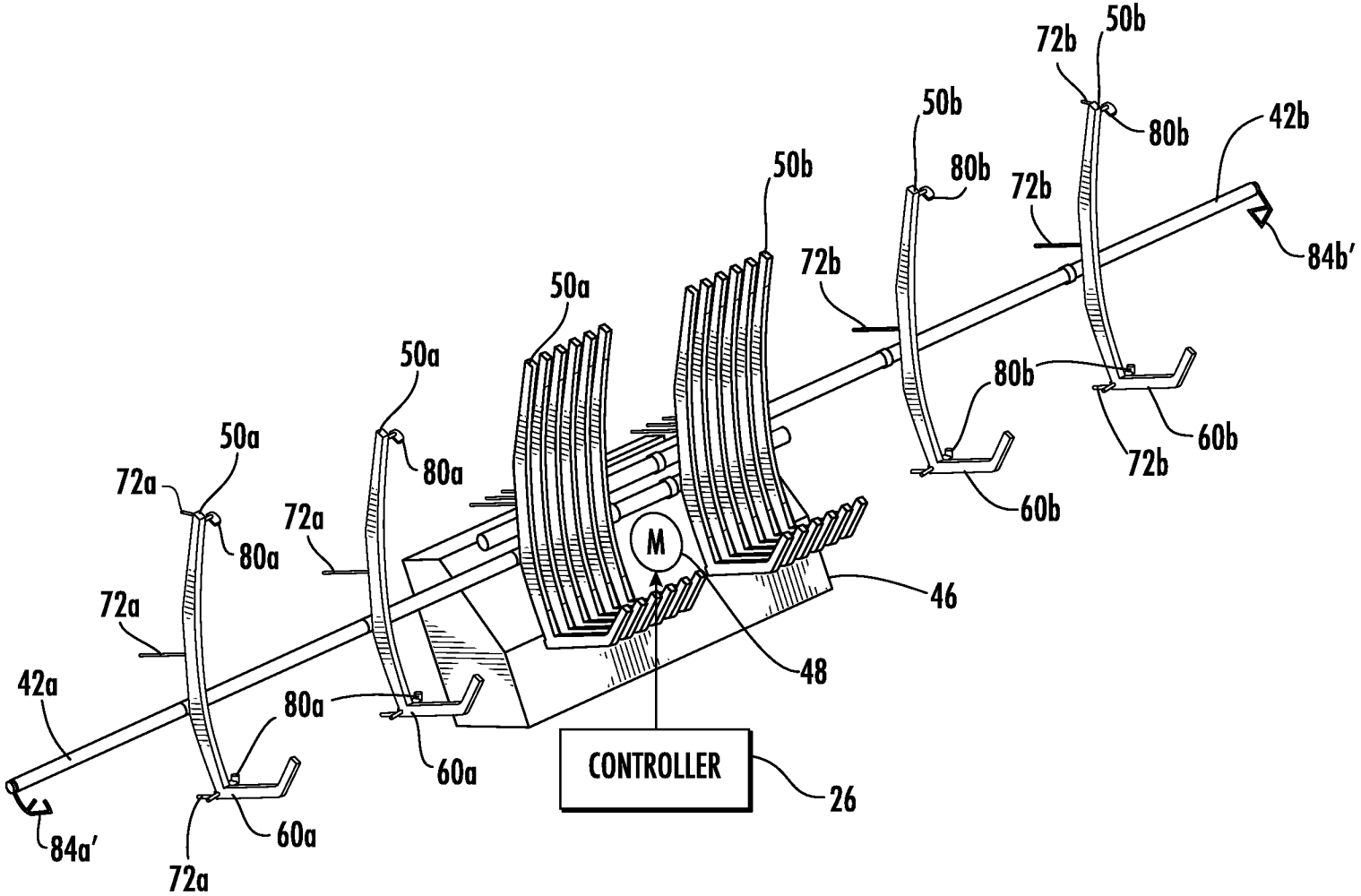
FIG. 7 is another fragmentary, isometric view similar to FIG. 6, but showing the first and second extensible booms in a partially deployed position.

As illustrated in FIGS. 6 and 7, a drive motor shown schematically at 48 is supported in the support pedestal 46 and connected to the controller 36. When the support pedestal 46 is extended outward from the satellite housing 22 to deploy the antenna. 40, the drive motor 48 engages the first and second extensible booms 42*a*, 42*b* and drives them outward in a telescoping fashion as shown in FIG. 7. The drive motor 48 may engage the first and second extensible booms 42*a*, 42*b* by jack screws that are compact and fold down for compaction when the antenna 40 is in the stored position, or operate via other drive mechanism, such as a cable arrangement. It is also possible to use an expanding gas to telescope outward the first and second extensible booms 42*a*, 42*b*, for example, by expanding a compressed nitrogen gas or other compressed gas inside each of the first and second extensible booms. The controller 26, which is contained within the satellite housing 22, controls deployment of the antenna 40 after the satellite 20 reaches the desired orbit by deploying outward the support pedestal 46 and then deploying the first and second extensible booms 42*a*, 42*b*.

A first set a ribs 50*a* are carried by the first extensible boom 42*a* and a second set of ribs 50*b* are carried by the second extensible boom 42*b*. The first and second sets of ribs 50*a*, 50*b* are configured to be in spaced apart relation when the first and second extensible booms 42*a*, 42*b* are in the deployed position, as illustrated in FIGS. 1 and 7, with FIG. 7 showing the first and second extensible booms in a partially deployed position and telescoped outward. The first two sequentially positioned ribs 50*a*, 50*b* on each of the first and second extensible booms 42*a*, 42*b* are deployed for each of the first and second set of ribs in FIG. 7. As the first and second extensible booms 42*a*, 42*b* telescope outward, the individual ribs 50*a*, 50*b* extend outward sequentially starting with the outermost ribs as illustrated. In this example, the two center most ribs 50*a*, 50*b* are fixed and do not move.

A radio frequency (RF) reflective film 54 is carried by the first and second sets of ribs 50*a*, 50*b* to define a curved or parabolic RF reflector surface indicated generally at 56

(FIGS. 1 and 8), similar to a trough shape for the antenna 20. In this example, the RF reflective film 54 is formed as a reflective mesh, which may be formed as a knit structure 57, shown in FIG. 8 by the enlarged section broken away from the RF reflective film. The RF reflective film 54 forming the RF reflector surface 56 is connected to each of the first and second sets of ribs 50*a*, 50*b* to form the parabolic RF reflector surface 56. Each portion of the RF reflective film 54 positioned between the ribs 50*a*, 50*b* forms an antenna panel or bulkhead as some skilled in the art may refer to that section. The curved RF reflector surface 56 is defined by the curved or parabolic shape of each rib 50*a*, 50*b* as best shown in the side elevation view of the example rib 50*a* in FIG. 8.

Figure 8:
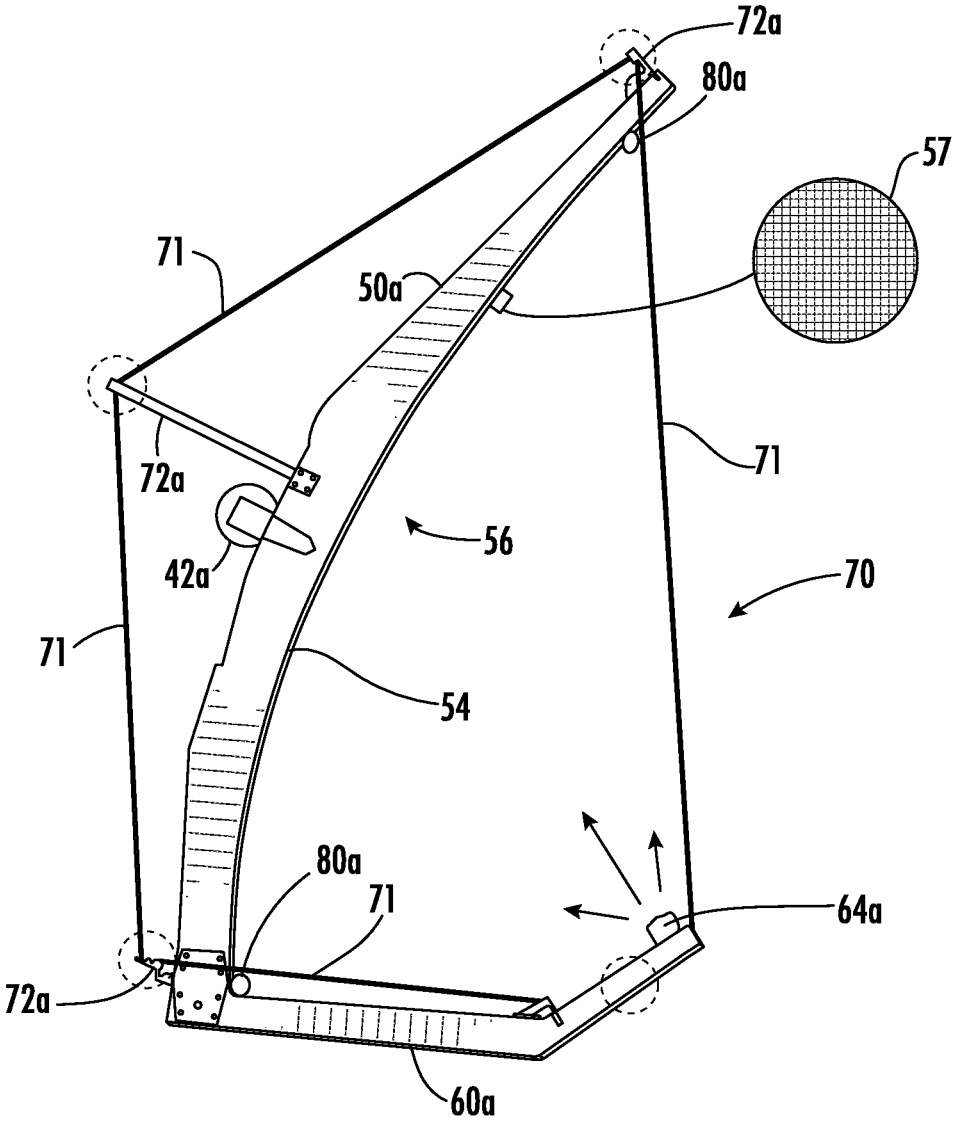
FIG. 8 is a fragmentary, side elevation view of an example rib that supports fiducial devices and showing a cord network and enlarged section of the RF reflective film as an RF reflective mesh.

As best shown in each of FIGS. 6-8, each of the first and second sets of ribs 50*a*, 50*b* includes a support arm 60*a*, 60*b* connected to a lower end of each rib, and extending outwardly therefrom to support an electronically scanned array (ESA) feed bar 62 (FIG. 1), such that a first set of phased array feeds 64*a* are carried by the first extensible boom 42*a* via the support arms 60*a* and ESA feed bar 62, and a second set of phased array antenna feeds 64*b* are carried by the second extensible boom 42*b* via the support arms 60*a* and ESA feed bar 62. The ESA feed bar 62 likewise may be extensible and split into two sections similar to first and second extensible beams 42*a*, 42*b* and the phased array antenna feeds 64*a*, 64*b* connect via wired connections to the controller 26, or communicate wirelessly to the controller and are mounted at the support arms 60*a*, 60*b*.

Use of the ESA feed bar 62 provides for better and more accurate positioning of the phased array antenna feeds 64*a*, 64*b*. The first and second sets of phased array antenna feeds 64*a*, 64*b* are directed toward the RF reflective film 54 as best illustrated in the side elevation view of the example rib 50*a* in FIG. 8, showing an example phased array antenna feed 64*a* directed toward the RF reflective film. Individual phased array antenna feeds as antenna feed elements 64*a*, 64*b* are connected to the ESA feed bar 62. In this example, two phased array antenna feeds as antenna feed elements 64*a*, 64*b* are carried on the ESA feed bar between each pair of adjacent ribs 50*a*, 50*b* as shown in FIG. 1. The ESA feed bar 62 connects to the controller 26, which controls electronic scanning of the first and second sets of phased array feeds 64*a*, 64*b* for phased array operation.

As best illustrated in FIGS. 1 and 8, a cord network 70 is coupled to the first and second sets of ribs 50*a*, 50*b* to form a truss of individual cords 71 as longerons and diagonal truss elements. The bending loads may be carried in differential tension in the cord network 70. The plane loads resist bending. Loads are carried in differential tension between the longerons as cords that extend longitudinally along the antenna 40, and loads are carried in shear and in torsion by diagonals as cords that help support the antenna. Cord support rods 72*a*, 72*b* (FIGS. 7 and 8) extend out from the rear side of each of the first and second sets of ribs 50*a*, 50*b* and connect with the cord network 70. In the example shown in FIGS. 7 and 8, a short cord support rod 72*a*, 72*b* is positioned at the rear side of each end of a rib 50*a*, 50*b* and a longer cord support rod 72*a*, 72*b* is medially located along the rear side, which provides enhanced cord 71 support in that configuration. The cord network 70 may connect to the ESA feed bar 62 and provide added support for the support arm 60*a*, 60*b* of each rib 50*a*, 50*b*.

The cord network 70 is slack when the antenna 40 is stored within the satellite housing 22, but upon deployment of the antenna into the deployed position, the cord network 70 tightens and provides support to the antenna. The cords 71 that form the cord network 70 connect to the cord support rods 72*a*, 72*b* and spread tension across the antenna 40 and the different panels or bulkheads formed from the RF reflective film 54 and engage the first and second sets of ribs 50*a*, 50*b*. The diagonal cords 71 stiffen the antenna 20 structure in torsion, and the longeron cords that extend longitudinally stiffen the antenna structure and balance the RF reflective film 54 tension across its depth. The cord network 70 helps provide tension to maintain the parabolic or trough shape of the RE reflective film 54. The total mesh tension of the RE reflective film 54 may be about 11 to 12 pounds in an example, and the different tensions of individual cords 71 against the corners and ends of a rib 54*a*, 54*b* may be about 4 to 5 pounds, and impart about 6 pounds tension on the cord support rods 72*a*, 72*b*.

In a non-limiting example, the antenna aperture formed by the RF reflective film 54 in this example is about 27 meters long and about 1.9 meters in height. The antenna 40 dimensions and configuration may vary depending on design and operating conditions chosen by those skilled in the art. It is possible to attach the sets of ribs 50*a*, 50*b* so that they slide along the first and second extensible booms 42*a*, 42*b* instead of being fixed to the extensible booms.

A first set of fiducial devices 80*a* are carried by the first set of ribs 50*a*, and a second set of fiducial devices 80*b* are carried by the second set of ribs 50*b* as shown in FIG. 1 and in the partially deployed ribs of FIG. 7. At least one camera, and in this example, first and second cameras 84*a*, 84*b* (FIG. 1), are directed toward the first and second sets of fiducial devices 80*a*, 80*b* to sense a physical distortion of the RF reflective film 54. The controller 26 cooperates with the first and second cameras 84*a*, 84*b* to operate the first and second sets of phased array antenna feeds 64*a*, 64*b* to account for sensed physical distortion of the RF reflective film 54 such as by adjusting phase of the first and second sets of phased array antenna feeds. In this example, the first camera 84*a* is directed toward the first set of fiducial devices 80*a* and the second camera 84*b* is directed toward the second set of fiducial devices 80*b*. In the example shown in FIG. 1, the first and second cameras 84*a*, 84*b* are positioned at a midpoint between the first and second extensible booms 42*a*, 42*b* and are mounted on the support pedestal 46 and extend outward therefrom to image the first and second set of fiducial devices 80*a*, 80*b* carried by the respective first and second set of ribs 50*a*, 50*b*. Each camera 84*a*, 84*b* has a feed element (not shown) that extends within the support pedestal 46 and connects to the controller 26 via a bus. The controller 26 cooperates with the first and second cameras 84*a*, 84*b* and also operates first and second sets of phased array feeds 64*a*, 64*b* and accounts for sensed physical distortion of the RF reflective film 54 by controlling the phased array scanning to compensate for any distortion in the RF reflective film 54.

In an example, a fiducial device 80*a*, 80*b* is mounted to each of the upper and lower ends of each of the first and second sets of ribs 50*a*, 50*b*. The respective medially located cameras 84*a*, 84*b* image the respective fiducials 80*a*, 80*b*. In an alternative arrangement for imaging, the first camera 84*a*' may be carried at the distal end of the first extensible boom 42*a* and the second camera 84*b*' may be carried at the distal end of the second extensible boom 42*b* as shown in FIG. 7.

Figure 2:
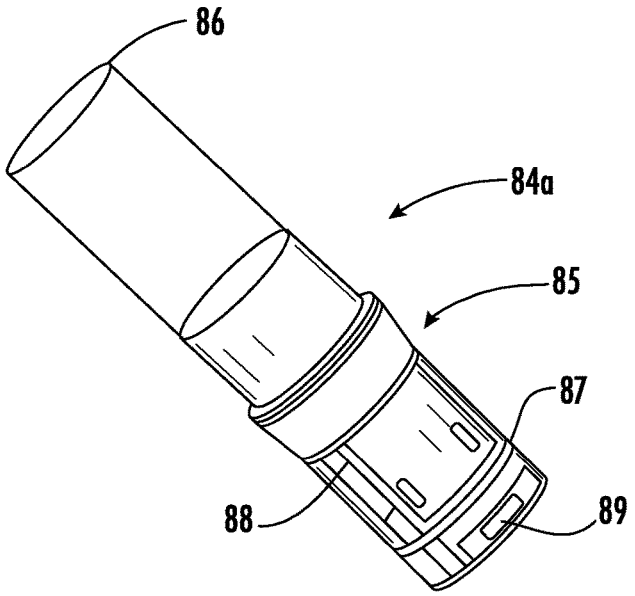
FIG. 2 is an isometric view of an example camera as an optical sensor that may be incorporated with the antenna of FIG. 1.

In an example, each camera 84*a*, 84*b* may be formed as an optical sensor and sunshield associated therewith as shown in FIG. 2, showing the first camera 84*a* as an optical sensor 85 and its sunshield 86 as a modified star tracker device, such as the CT-2020 star tracker device manufactured by Ball Aerospace. The optical sensor 85 is modified with a 15° aperture imaging. The sunshield 86 blocks out exposure beyond a minimum angle off the bore site. This type of optical sensor 85 includes a housing 87 formed as a compact and fully integrated package and a CMOS detector 88. Connection ports 89 may connect to connectors (not shown), which connect to a bus in the support pedestal 46 and to the controller 26. If the first and second cameras 84*e*, 84*b*' are carried at the distal end of the respective first and second extensible booms 42*a*, 42*b*, any wired connections may extend through the first and second extensible booms. Alternatively, a wireless module can be connected to the cameras 84*a*', 84*b*' and connect wirelessly to the controller 26 mounted in the satellite housing 22. It is also possible that the medially located cameras 84*a*, 84*b* may be wireless.

Figure 3:
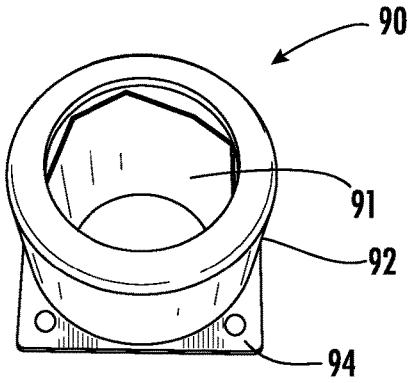
FIG. 3 is an isometric view of an example active fiducial device as a reflective target that may be incorporated with the antenna of FIG. 1.

Different types of fiducial devices 80*a*, 80*b* may be used, such as active and passive devices. An example active fiducial device is a reflective target 90 (FIG. 3), such as a corner cube with an illuminator 91 in the central portion of its housing 92. The reflective target 90 requires no power and wiring, and control is established specifically at the reflective target itself. Disadvantages of the reflective target 90 are its low brightness, its sensitivity to angular displacement, and its requirement for an illuminator to help in camera imaging. This reflective target 90 may be mounted to a respective rib 50*a*, 50*b* via a bracket 94 and screwed into the ends of the ribs where the RF reflective film 54 is supported and carried thereon.

Figure 4:
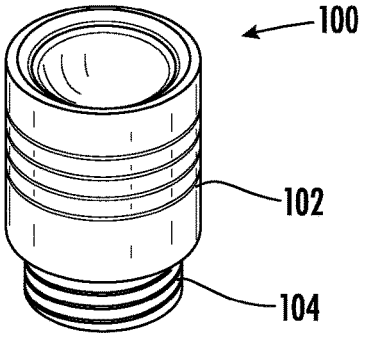
FIG. 4 is another example of an active fiducial device as a light emitting diode (LED) that may be incorporated with the antenna of FIG. 1.

Referring to FIG. 4, another active fiducial device is formed as a light emitting diode (LED) 100 supported in an LED housing 102 and having a threaded fastener end 104 that may be screwed into each end of the ribs 50*a*, 50*b*. An LED 100 has a brighter output than the reflective target 90 and may be customized in brightness and spectrum for a target. An LED 100 requires power and wiring along the ribs 50*a*, 50*b* and through the extensible booms 42*a*, 42*b* to a power source contained in the satellite housing, such as batteries connected to the solar panel 28. Alternatively, the LED's 100 may include a surface that supports small solar cells that receive solar energy to power the LED's and store energy in batteries.

Figure 5:
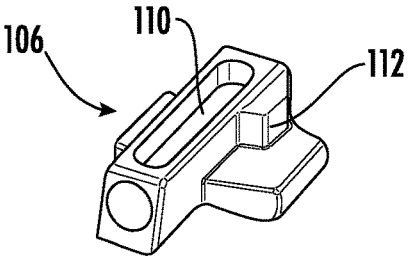
FIG. 5 is an example of a passive fiducial device as a tritium target that may be incorporated with the antenna of FIG. 1.

The fiducial devices 80*a*, 80*b* may be formed as a tritium target 106 and use a radio luminescent paint 110 that is exposed within a passive device housing 112 (FIG. 5) and mounted on the ends of the first and second sets of ribs 50*a*, 50*b*. Tritium targets 106 are advantageous because they require no power or wiring as with the LED's 100 and no illuminator as with the reflective targets 90. The tritium targets 106, however, have low brightness and may not be accurate and constantly emit radiation, which may not be advantageous in some type of imaging systems. In an example, a tritium target 106 may use a 0.2 millimeter thick silver layer with a 1.0 micrometer layer of titanium deposited on the surface that is then saturated with tritium. It is also possible to use a low hydrogen diffusion into a deuterium target by bombardment of deuterons until the metal is saturated to form the tritium target.

In operation, the antenna 40 is extended outward from the satellite housing 22 when the satellite 20 reaches the desired altitude above the Earth, and the first and second extensible booms 42*a*, 42*b* extend outwardly from the satellite in opposite directions from the stored position to a deployed position. The first and second sets of ribs 50*a*, 50*b* move sequentially outward such as shown in FIG. 7. When the antenna 20 is fully deployed, the individual cords 71 in the cord network 70 coupled to the first and second sets of ribs 50*a*, 50*b* carry the differential tension, shear and torsion to help support the antenna.

Figure 9:
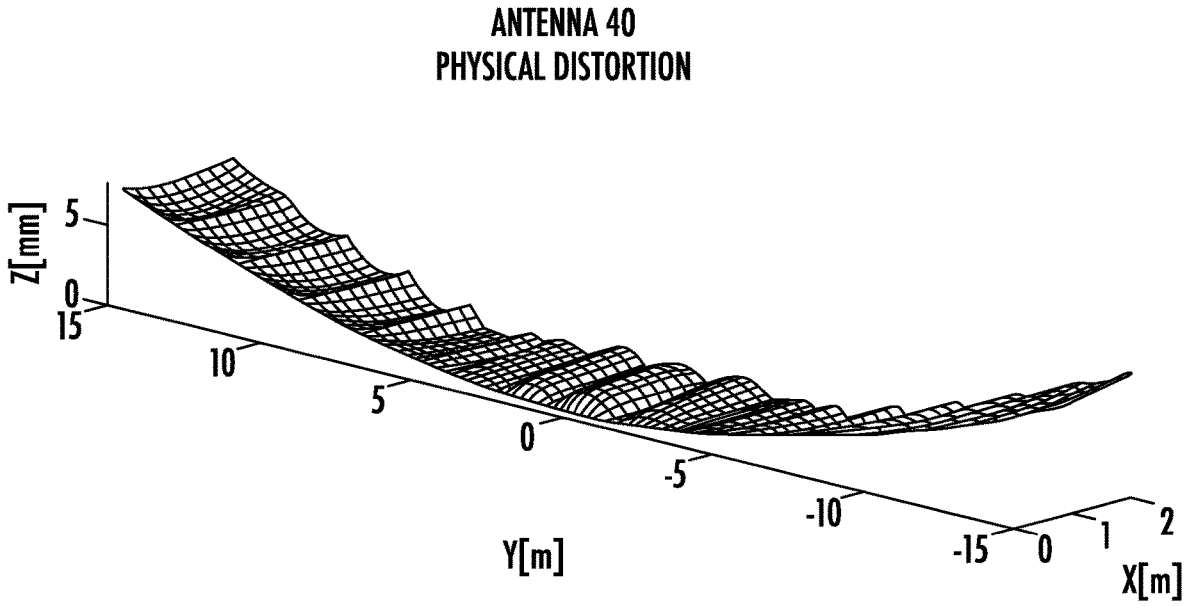
FIG. 9 is a graph showing an example of the magnitude of physical distortion in millimeters that may occur in the antenna of FIG. 1.

As shown in the graph of FIG. 9, this type of deployable parabolic antenna, which is about 30 meters long, and in one example, 27 meters, may still have some deflection. In a worst case scenario, the deflection as shown in the graph of FIG. 9 for the RF reflector surface 56 can be about 5 millimeters or more at the ends of the antenna 20 as shown in the "Z" direction. This may be an unacceptable deformation and can impact antenna 40 and satellite 20 operation. As explained above, the controller 26 cooperates with the first and second cameras 84*a*, 84*b*, which images the fiducials 80*a*, 80*b*, and the controller calculates and measures the distortion. The controller 26 operates the first and second sets of phased array feeds 64*a*, 64*b* to account for sensed physical distortion of the RF reflective film 54.

Figure 10:
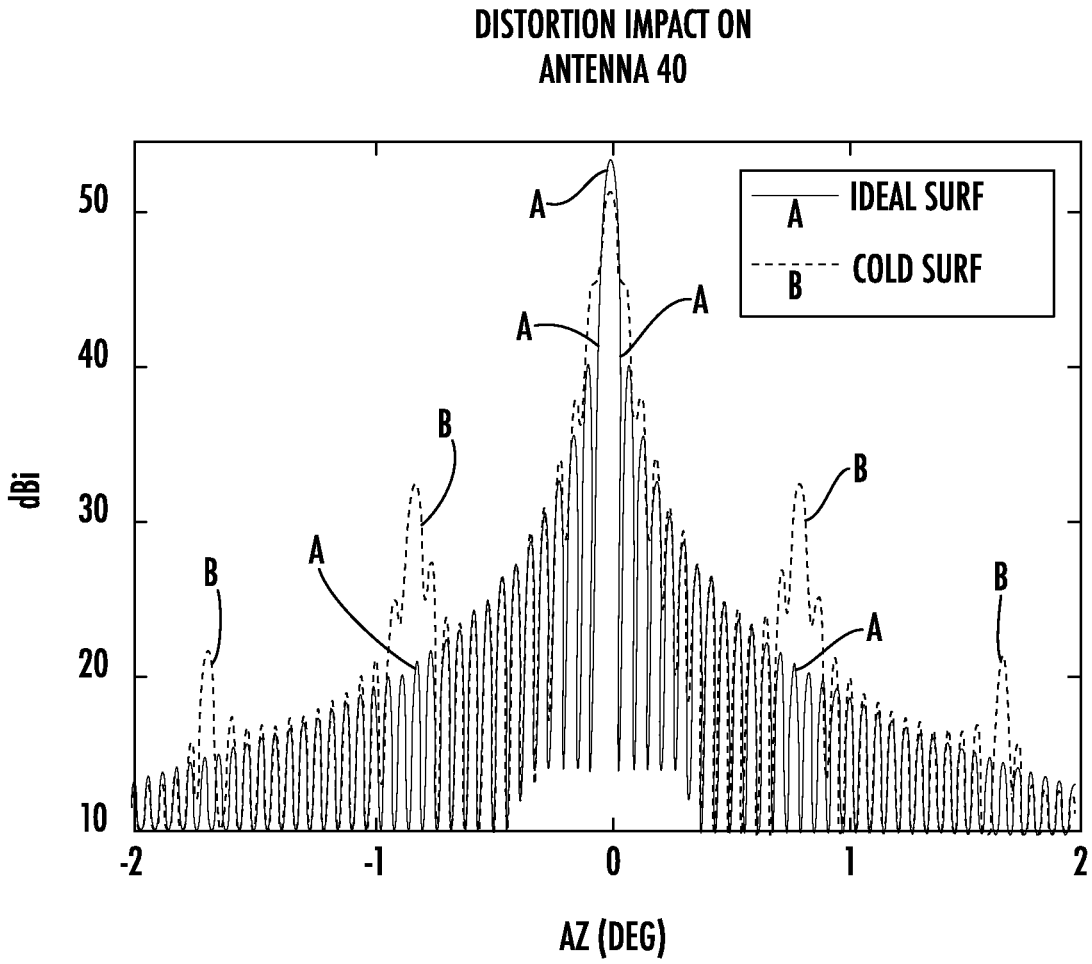
FIG. 10 is a graph of the distortion impact when there is no compensation for physical distortion in the antenna of FIG. 1.

FIG. 10 is a graph showing the distortion impact in the antenna beam labeled "A" without any compensation for an ideal RF reflector surface 56 for the RF reflective film 54. When compared with the actual "cold" surface corresponding to an extreme deflection of the antenna 20, the main antenna beam is down several decibels for the antenna beam labeled "B." The first side lobes are folded into the main beam, indicating a significant impact on antenna performance.

Figure 11:
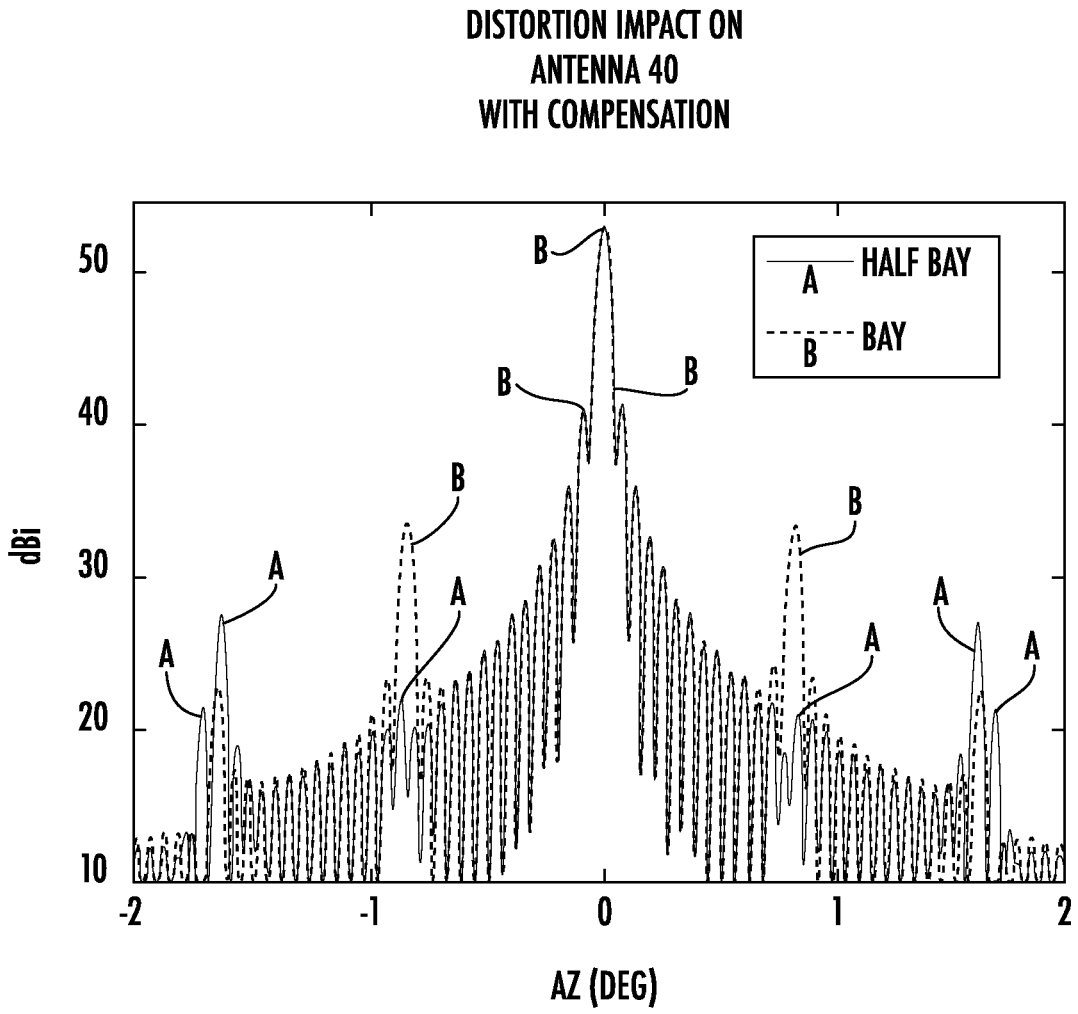
FIG. 11 is a graph showing the distortion impact when there is compensation for sensed physical distortion in the antenna of FIG. 1.

Referring now to FIG. 11, there is illustrated a graph of the antenna beam when the controller 26 cooperates with the cameras 84*a*, 84*b* to operate the first and second sets of phased array antenna feeds 64*a*, 64*b* to account for the sensed physical distortion of the RF reflective film 54 using the cameras 84*a*, 84*b* directed toward the first and second sets of fiducial devices 80*a*, 80*b* to sense the physical distortion of the RF reflective film 54. The controller 26 may make model-based corrections based on the model physical distortion shown in FIG. 9 that are informed by the reduced-order observations at the positions of the fiducial devices 80*a*, 80*b*. In this example, the "bay" graph line labeled "B" corresponds to fiducial devices 80*a*, 80*b* on the ends of each rib 50*a*, 50*b*, and no other fiducial devices. The graph line "B" shows the baseline and corrections can be made at that baseline, and shows the compensation pattern for the physical distortion. There are still some side lobes, but the first order side lobes fixed to the main beam are adequate. It is possible to include fiducial devices 80*a*, 80*b* also at the half bay position, i.e., additional fiducial devices are located between the ribs 50*a*, 50*b*, such that fiducial devices could be located not only on the ends of each rib 50*a*, 50*b*, but also on some type of support located midway between the ribs. This was modeled as shown in the graph of FIG. 11 for the half bay graph line indicated at "A" and referred to as the half bay interval. It is evident that some of the side lobes were reduced and this improved the first order side lobes, but slightly increased the second order side lobes.

Figure 12:
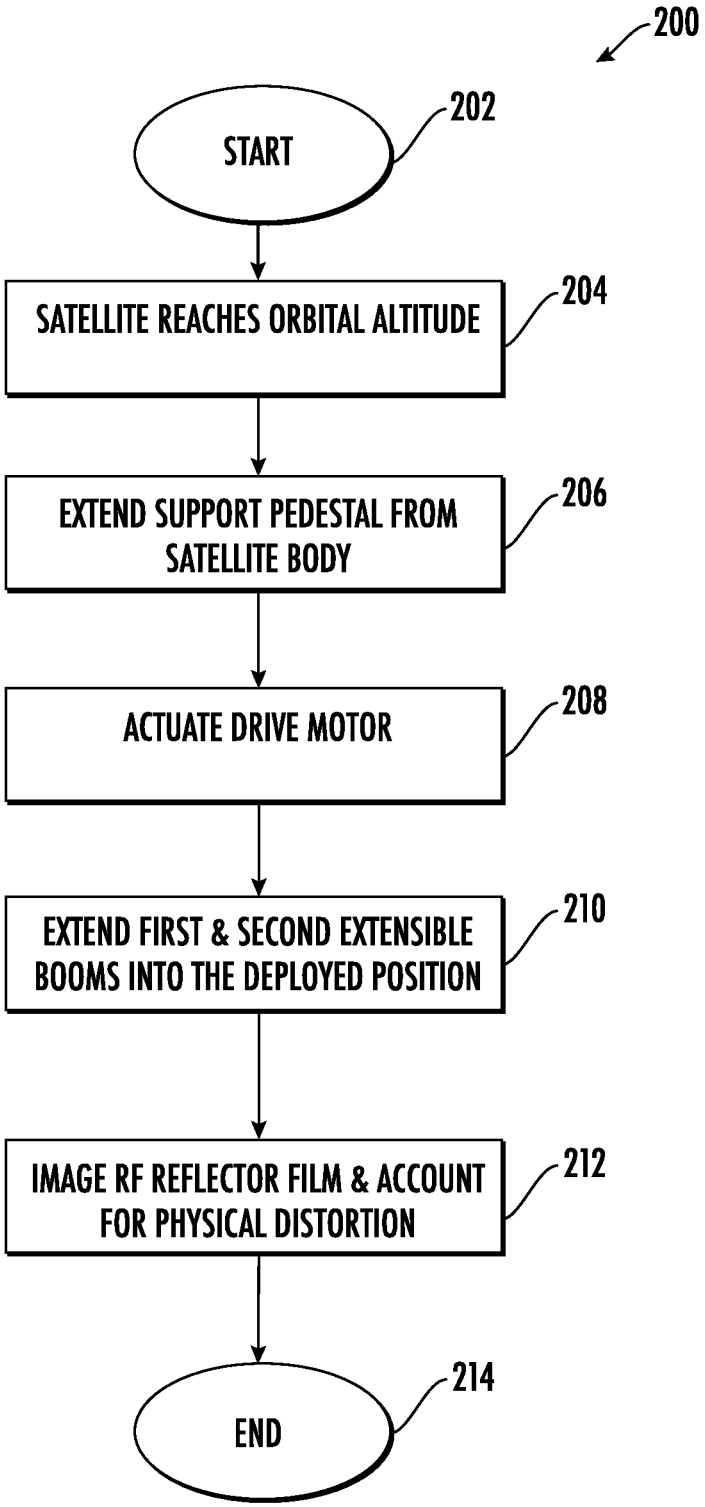
FIG. 12 is a high-level flowchart of a method for deploying and using the antenna of FIG. 1.

Referring now to FIG. 12, a high-level flowchart of a method used for deploying and using the antenna 40 of FIG. 1 is illustrated as shown generally at 200. The process starts (Block 202) and when the satellite 20 reaches a predetermined orbital altitude (Block 204), the support pedestal 46 for the antenna is extended outward from the satellite housing 22 (Block 206).

The drive motor 48 is activated (Block 208) and the first and second extensible booms 42*a*, 42*b* of the antenna 40 are extended outwardly from the satellite 20 in opposite directions from the stored position to a deployed position (Block 210). The antenna 40 includes the basic components as described above and the controller 26 is operated to cooperate with the cameras 84*a*, 84*b* to image the RF reflective film 54 and operate the first and second sets of phase array antenna feeds 64*a*, 64*b* to account for the sensed physical distortion of the RF reflective film 54 (Block 212). The process ends at Block 214.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna for a satellite comprising:

first and second extensible booms, each configured to extend outwardly from the satellite in opposite directions from a stored position to a deployed position;

a first set of ribs carried by the first extensible boom and a second set of ribs carried by the second extensible boom, the first and second sets of ribs configured to be in spaced apart relation when the first and second extensible booms are in the deployed position;

a Radio Frequency (RF) reflective film carried by the first and second sets of ribs to define a curved RF reflector surface;

a first set of phased array antenna feeds carried by the first extensible boom and a second set of phased array antenna feeds carried by the second extensible boom, the first and second sets of phased array antenna feeds directed toward the RF reflective film;

a first set of fiducial devices carried by the first set of ribs and a second set of fiducial devices carried by the second set of ribs;

at least one camera directed toward the first and second sets of fiducial devices to sense a physical distortion of the RF reflective film; and a controller cooperating with the at least one camera to operate the first and second sets of phased array antenna feeds to account for sensed physical distortion of the RF reflective film.

2. The antenna of claim 1 wherein the at least one camera comprises:

a first camera directed toward the first set of fiducial devices; and a second camera directed toward the second set of fiducial devices.

3. The antenna of claim 2 wherein the first and second cameras are positioned at a midpoint between the first and second extensible booms.

4. The antenna of claim 2 wherein the first camera is carried at a distal end of the first extensible boom, and the second camera is carried at a distal end of the second extensible boom.

5. The antenna of claim 1 wherein the at least one camera comprises an optical sensor and a sun shield associated therewith.

6. The antenna of claim 1 wherein each of the first and second set of fiducial devices comprises a passive fiducial device.

7. The antenna of claim 1 wherein each of the first and second set of fiducial devices comprises an active fiducial device.

8. The antenna of claim 1 comprising a cord network coupled to the first and second sets of ribs.

9. The antenna of claim 1 wherein the RF reflective film comprises an RF reflective mesh.

10. An antenna for a satellite comprising:

first and second extensible booms, each configured to extend outwardly from the satellite in opposite directions from a stored position to a deployed position;

a first set of ribs carried by the first extensible boom and a second set of ribs carried by the second extensible boom, the first and second sets of ribs configured to be in spaced apart relation when the first and second extensible booms are in the deployed position;

a cord network coupled to the first and second sets of ribs;

a Radio Frequency (RF) reflective film carried by the first and second sets of ribs to define a curved RF reflector surface;

a first set of phased array antenna feeds carried by the first extensible boom and a second set of phased array antenna feeds carried by the second extensible boom, the first and second sets of phased array antenna feeds directed toward the RF reflective film;

a first set of fiducial devices carried by the first set of ribs and a second set of fiducial devices carried by the second set of ribs;

a first camera directed toward the first set of fiducial devices, and a second camera directed toward the second set of fiducial devices, the first and second cameras configured to sense a physical distortion of the RF reflective film; and a controller cooperating with the first and second cameras to operate the first and second sets of phased array antenna feeds to account for sensed physical distortion of the RF reflective film.

11. The antenna of claim 10 wherein the first and second cameras are positioned at a midpoint between the first and second extensible booms.

12. The antenna of claim 10 wherein the first camera is carried at a distal end of the first extensible boom, and the second camera is carried at a distal end of the second extensible boom.

13. The antenna of claim 10 wherein each of the first and second cameras comprises an optical sensor and a sun shield associated therewith.

14. The antenna of claim 10 wherein each of the first and second set of fiducial devices comprises a passive fiducial device.

15. The antenna of claim 10 wherein each of the first and second set of fiducial devices comprises an active fiducial device.

16. The antenna of claim 10 wherein the RF reflective film comprises an RF reflective mesh.

17. A method for deploying and using an antenna for a satellite comprising:

extending first and second extensible booms of the antenna outwardly from the satellite in opposite directions from a stored position to a deployed position;

the antenna comprising a first set of ribs carried by the first extensible boom and a second set of ribs carried by the second extensible boom, the first and second sets of ribs moved into spaced apart relation when the first and second extensible booms are moved into the deployed position, a Radio Frequency (RF) reflective film carried by the first and second sets of ribs to define a curved RF reflector surface, a first set of phased array antenna feeds carried by the first extensible boom and a second set of phased array antenna feeds carried by the second extensible boom, the first and second sets of phased array antenna feeds directed toward the RF reflective film, a first set of fiducial devices carried by the first set of ribs and a second set of fiducial devices carried by the second set of ribs, and at least one camera directed toward the first and second sets of fiducial devices to sense a physical distortion of the RF reflective film; and operating a controller to cooperate with the at least one camera to operate the first and second sets of phased array antenna feeds to account for sensed physical distortion of the RF reflective film.

18. The method of claim 17 wherein the at least one camera comprises:

a first camera directed toward the first set of fiducial devices; and a second camera directed toward the second set of fiducial devices.

19. The method of claim 18 wherein the first and second cameras are positioned at a midpoint between the first and second extensible booms.

20. The method of claim 18 wherein the first camera is carried at a distal end of the first extensible boom, and the second camera is carried at a distal end of the second extensible boom.

21. The method of claim 17 wherein the at least one camera comprises an optical sensor and a sun shield associated therewith.

22. The method of claim 17 wherein each of the first and second set of fiducial devices comprises a passive fiducial device.

23. The method of claim 17 wherein each of the first and second set of fiducial devices comprises an active fiducial device.

* * * * *